US007015661B2

(12) United States Patent
Korenev

(10) Patent No.: US 7,015,661 B2
(45) Date of Patent: Mar. 21, 2006

(54) METHOD AND APPARATUS FOR ACCELERATING CHARGED PARTICLES

(75) Inventor: Sergey A. Korenev, Mundelein, IL (US)

(73) Assignee: STERIS Inc., Temecula, CA (US)

( * ) Notice: Subject to any disclaimer, the term of this patent is extended or adjusted under 35 U.S.C. 154(b) by 89 days.

(21) Appl. No.: 10/800,583

(22) Filed: Mar. 15, 2004

(65) Prior Publication Data

US 2005/0200320 A1 Sep. 15, 2005

(51) Int. Cl.
*H01J 23/00* (2006.01)

(52) U.S. Cl. ..... 315/500; 315/5; 250/492.21; 250/281; 250/291; 376/129

(58) Field of Classification Search ..... 315/500–507, 315/5; 250/492.21; 376/140; 422/186; 335/306; 435/172.3
See application file for complete search history.

(56) References Cited

U.S. PATENT DOCUMENTS 5,324,646 A * 6/1994 Buising et al. ..... 800/293
5,363,008 A 11/1994 Hiramoto et al. ..... 313/62
5,596,304 A * 1/1997 Tatchyn ..... 335/306
6,423,976 B1 * 7/2002 Glavish et al. ..... 250/492.21
6,459,089 B1 10/2002 Masefield et al. ..... 250/453.11
2002/0060521 A1 * 5/2002 Mako et al. ..... 315/5
2004/0033176 A1 * 2/2004 Lee et al. ..... 422/186
2004/0047442 A1 * 3/2004 Monkhorst et al. ..... 376/140
2004/0256230 A1 * 12/2004 Yager et al. ..... 204/450

OTHER PUBLICATIONS

Humphries, "*Principles of Charged Particle Acceleration*," chapter 1, pp. 1-7; chapter 2, pp. 8-10; chapter 14, pp. 493-499, and chapter 15, pp. 500-509, John Wiley and Sons, 1999.

* cited by examiner

*Primary Examiner*—Trinh V Dinh
*Assistant Examiner*—Binh Van Ho
(74) *Attorney, Agent, or Firm*—Kusner & Jaffe; Michael A. Centanni

(57) ABSTRACT

A method and apparatus for accelerating charged particles. The charged particles accelerate as they travel through electric fields produced by a plurality of accelerating elements having first and second electrode plates. A magnetic field produced by a pair of magnets causes the charged particles to travel in a generally circular orbit.

15 Claims, 3 Drawing Sheets

METHOD AND APPARATUS FOR ACCELERATING CHARGED PARTICLES

FIELD OF THE INVENTION

The present invention relates to charged particle acceleration, and more particularly to a method and apparatus for electromagnetic acceleration of charged particles.

BACKGROUND OF THE INVENTION

A charged particle is an elementary particle or a macroparticle that contains an excess of positive or negative charge. A collection of charged particles is referred to as a "particle beam." The motion of a charged particle is largely determined by interaction with electromagnetic forces. A charged particle accelerator does work, and thus imparts kinetic energy to a charged particle by application of an electric field.

Kinetic energy is imparted to charged particles via electromagnetic forces. For example, a power supply may generate a voltage difference between a pair of metal plates by subtracting negative charge from the first plate and moving it to the second plate. A charged particle that moves between the metal plates is accelerated by forces associated with the electric field developed between the two plates ($\vec{F}=q\vec{E}$). Magnetic forces, acting in a direction transverse (i.e., perpendicular) to the velocity of the charged particle, keep a charged particle within a specific cross-sectional area and curve the path of the charge particle. Accordingly, the magnetic forces act as "confinement forces."

Particle accelerators are used in a wide variety of applications, including, but not limited to, generation of X-rays, sterilization of food products, modification of properties of materials, production of isotopes, manufacture of semiconductors, and medical and scientific research applications.

Cyclotrons and microtrons are examples of prior art circular particle accelerators. A cyclotron is an apparatus that accelerates charged particles by using a high frequency alternating voltage across a magnetic field to spiral a charged particle in a generally circular path. More specifically, a cyclotron is generally comprised of two empty, semicircular D-shaped chambers, known as "dees." The two chambers are arranged relative to each other to define a narrow, empty slot therebetween. The dees are placed in a vacuum chamber between the poles of an electromagnet. A high frequency AC voltage is supplied to the dees to generate an electric field. A charged particle source injects charged particles into the vacuum chamber, wherein the charged particles are accelerated in the gap between the dees.

The cyclotron has several drawbacks. In this regard, a cyclotron has a magnetic field of constant magnitude and a constant radiofrequency AC voltage. The beam energy is limited by relativistic effects that destroy synchronization between particle orbits and radiofrequency fields. Accordingly, the cyclotron is not suitable for accelerating all types of ions.

The microtron combines linear accelerator technology with circular accelerator particle dynamics, and can produce a continuous beam of high-energy electrons with an average current of about 100 $\mu$A. One common type of microtron is known as a racetrack microtron. Electrons are accelerated in a short linear accelerator section. Magnets at each end of the linear accelerator confine the electrons to recirculate the beam through the linear accelerator. In this regard, the magnets produce uniform magnetic fields that cause the electrons to orbit half-circles that return the electrons to the linear accelerator. The size of the orbit increases as electron energy increase.

Among the drawbacks of microtrons are problems with beam steering and beam breakup instabilities. With regard to beam steering, the uniform magnetic field has horizontal focusing but no vertical focusing. Beam breakup instability is severe in the microtron because the current of all beams is concentrated in the high charge resonant cavities of the linear accelerator. The beam breakup instability limits the average current to less that 1 mA. Microtrons also have the drawback that they are limited to use with electrons.

The present invention addresses drawbacks of the prior art, and provides a novel method and apparatus for accelerating charged particles.

SUMMARY OF THE INVENTION

In accordance with the present invention, there is provided a particle accelerating apparatus for accelerating charged particles, comprising: (a) at least two pair of accelerating elements, each accelerating element including a first electrode plate and a second electrode plate, wherein said first and second electrode plates are spaced apart by a gap; (b) first and second magnets for producing a magnetic field B, wherein said plurality of accelerating elements are located between said first and second magnets; and (c) a voltage generator for applying a voltage V across each of said first and second electrode plates.

In accordance with another aspect of the present invention, there is provided a circular accelerator for accelerating the velocity of a charged particle, comprising: (a) at least two accelerating gaps; (b) means for producing an electric field in said accelerating gaps, wherein said charged particle is accelerated by said electric field; and (c) means for producing a magnetic field, wherein a travel path of said charged particle is influenced by said magnetic field.

In accordance with still another aspect of the present invention, there is provided a method for accelerating a charged particle, comprising: (a) applying a voltage across at least two pair of electrode plates defining an accelerating gap, said voltage producing an associated electric field; and (b) injecting a charged particle into said accelerating gap of one of said two pair of electrode plates; wherein said charged particle travels in a generally circular orbit through said accelerating gaps.

An advantage of the present invention is the provision of a method and apparatus for particle acceleration that is suitable for accelerating charged particles, including, but not limited to, electrons, ions, protons and charged cluster particles.

Another advantage of the present invention is the provision of a method and apparatus for particle acceleration that is more efficient than existing particle accelerators.

Still another advantage of the present invention is the provision of a method and apparatus for particle acceleration that is useful in producing low, average, and high power charged particle beams.

A still further advantage of the present invention is the provision of an apparatus for particle acceleration that is simple to manufacture and operate.

These and other advantages will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF A PREFERRED EMBODIMENT

Figure 1:
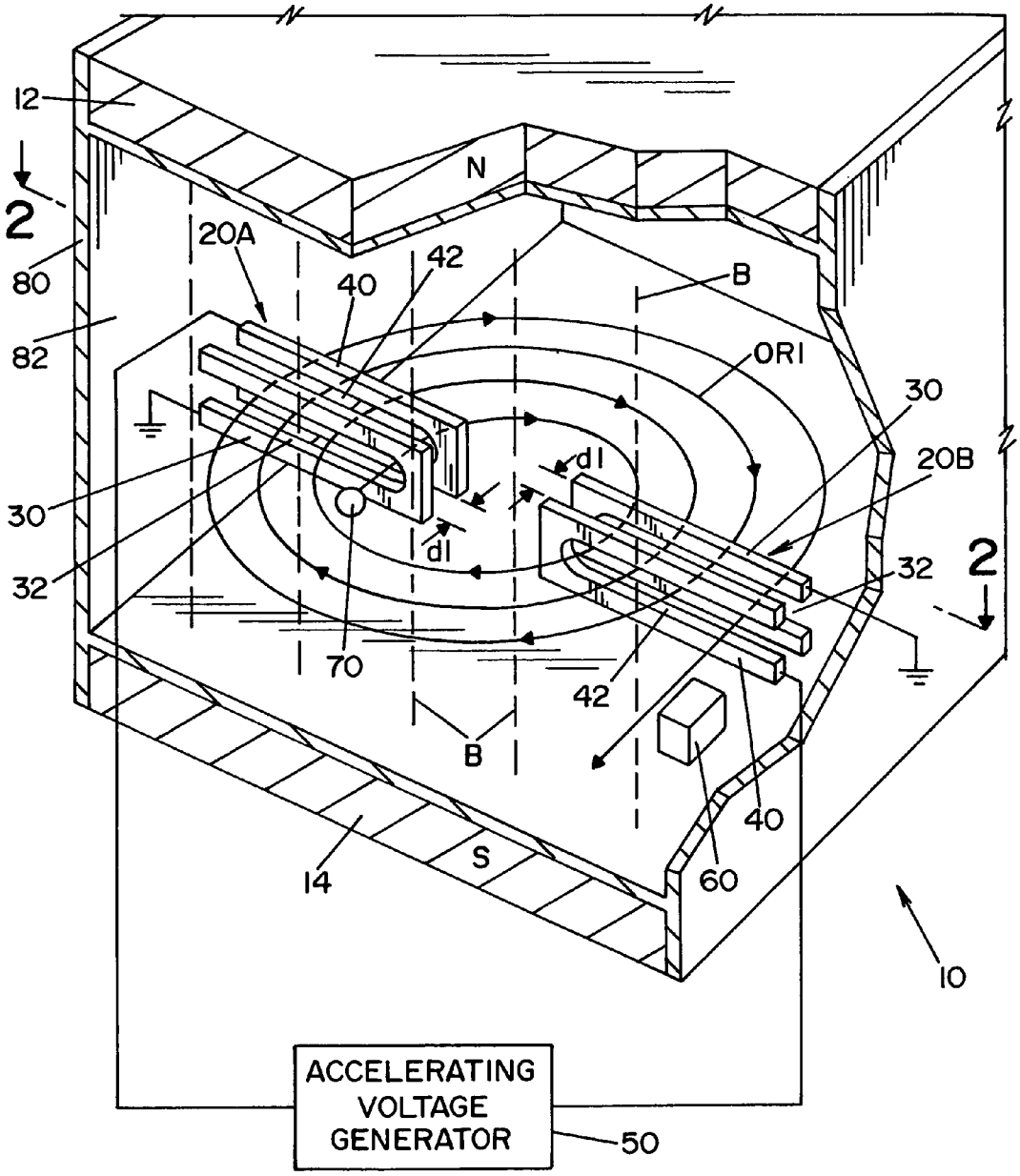
FIG. 1 is a perspective view partially in section of a particle accelerator according to a first embodiment of the present invention.
Figure 2:
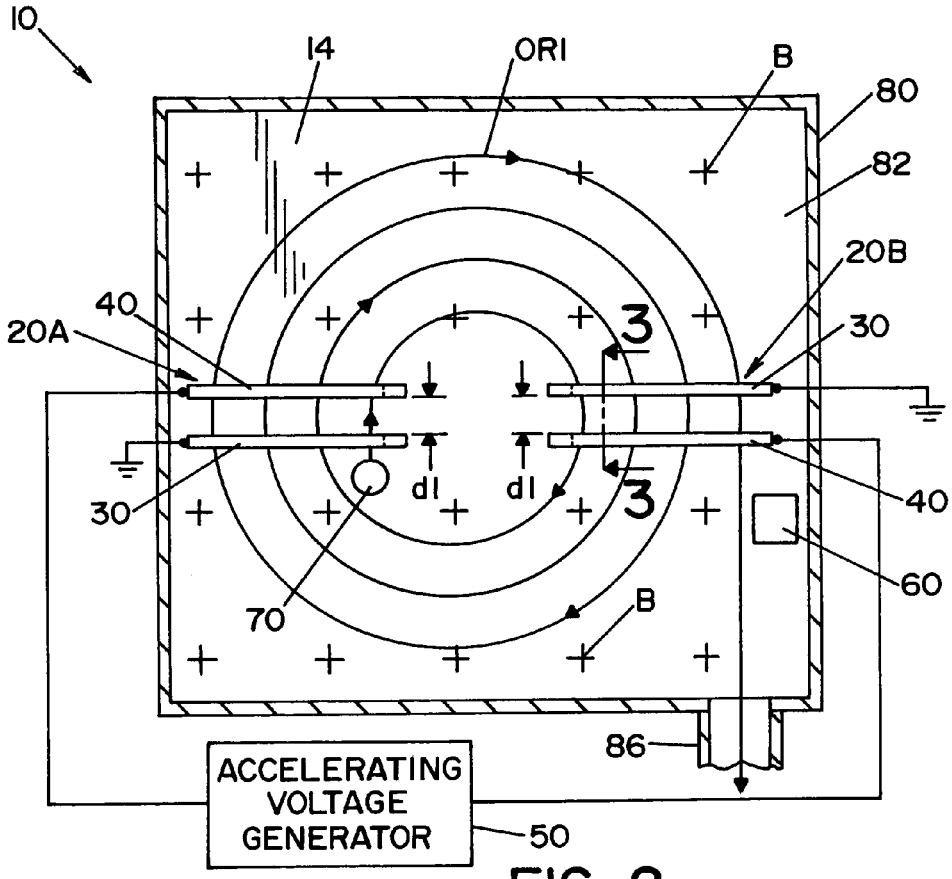
FIG. 2 is a cross-sectional view taken along lines 2—2 of FIG. 1.

Referring now to the drawings wherein the showings are for the purpose of illustrating a preferred embodiment of the invention only and not for purpose of limiting same, FIGS. 1 and 2 show a particle accelerator 10 according to a first embodiment of the present invention. Particle accelerator 10 is generally comprised of first and second magnets 12 and 14, a first accelerating element 20A, a second accelerating element 20B, an accelerating voltage generator 50, a deflecting magnet 60, a charged particle injector 70 for injecting charged particles, and a housing 80.

First and second magnets 12, 14 are respectively located above and below first and second accelerating elements 20A and 20B. First and second magnets 12 and 14 are generally planar magnets positioned parallel to each other, with opposite magnetic poles facing to produce a uniform magnetic field B, directed from first magnet 12 toward second magnet 14. Magnetic field B will vary according to the type of particle being accelerated. For instance, magnetic field B may be in the range of 0.05 T to 0.1 T for electron acceleration, and may be in the range of 10 T to 50 T for ion acceleration.

It should be understood that magnets 12 and 14 may take the form of different types of magnets depending upon the type of particle being accelerated. Magnets 12 and 14 may include, but are not limited to, permanent magnets, coil magnets, dipole magnets, electromagnets and superconducting magnets. A permanent magnet is preferred for use with electrons, while a superconducting magnet is preferred for ions.

Each accelerating element 20A, 20B is comprised of a first electrode plate 30 and a second electrode plate 40, preferably identical to first electrode plate 30. In accordance with a preferred embodiment of the present invention, first electrode plate 30 has a longitudinal slot 32 (see FIG. 4), and second electrode plate 40 has a longitudinal slot 42. First and second electrode plates 30, 40 are located parallel to each other, and are preferably made of copper. In the illustrated embodiment first and second electrode plates 30, 40 are preferably spaced apart to define a gap d1 in the range of 0.5 cm to 5 cm. Electrode plates 30, 40 preferably have a length L1 in the range of 10 cm to 50 cm, a width W1 in the range of 5 cm to 10 cm, and a thickness T1 in the range of 1 mm to 5 mm, (see FIGS. 3 and 4).

In accordance with a preferred embodiment, voltage generator 50 produces a pulsed DC voltage (V) in the range of 10 kV to 100 kV. Voltage V is applied across first and second electrode plates 30, 40 of accelerating elements 20A, 20B.

Deflecting magnet 60 preferably takes the form of a magnetic element, such as a dipole magnet. Deflecting magnet system 60 alters the generally circular trajectory of the accelerated particles in order to extract charged particles from particle accelerator 10, as will be described in further detail below.

A charged particle injector 70 provides a source of charged particles. For example, charged particle injector 70 may take the form of an electron gun that produces electrons by thermionic emission. The charged particles are injected in a direction toward the slots of one of the accelerating elements 20A, 20B, as will be described in further detail below. It should be understood that the charged particles injected by injector 70 may include, but are not limited to, electrons, protons, ions and cluster particles.

Housing 80 defines a chamber 82. Output port 86 provides an opening in housing 80 to allow accelerated particles to exit from chamber 82. Chamber 82 is evacuated to a very low air pressure (i.e., vacuum) in the entire region where charged particles are traveling. It should be understood that without low air pressure, the accelerated charged particles will be lost as they collide with air molecules.

Operation of particle accelerator 10 will now be described in detail. Particle accelerator 10 operates by accelerating charged particles with an electric field E. The charged particles are confined to a generally circular orbit OR1 with a magnetic field B. Electric field E is produced by applying voltage V across first and second electrode plates 30, 40 (see FIG. 3). Magnetic field B is produced by first and second magnets 12 and 14, arranged above and below accelerating elements 20A, 20B.

The electric force exerted on a charged particle due to an electric field is $\vec{F} = q\vec{E}$. If the electric force is in the direction that the charged particle is already traveling, then the charged particle will accelerate, resulting in an increased kinetic energy. When a charged particle is moving through magnetic field B it is influenced by a magnetic force (i.e., the Lorentz force) that is transverse (i.e., perpendicular) to the charged particle's direction of motion. Such a force causes the charged particle to change direction, but does not change the velocity nor the kinetic energy of the charged particle. In this respect, the charged particle will travel in a generally circular orbit OR1. The radius of the circle will depend on the velocity of the charged particle, the charge and the mass of the particle, and the strength of the magnetic field B, as will be explained in further detail below. Electric field E is synchronously applied to the charged particles to accelerate the charged particles each time the charged particles cross gap d1 between first and second electrode plates 30 and 40. Deflecting magnet 60 alters the trajectory of the accelerated charged particles to direct the charged particles to exit chamber 82 through output port 86.

Figure 3:
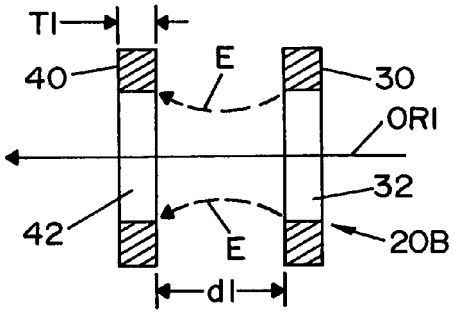
FIG. 3 is a cross-sectional view of a pair of electrode plates, taken along lines 3—3 of FIG. 2.

It should be understood that the velocity of the charged particles will increase as the charged particle is influenced by an electric field E (FIG. 3). As indicated above, electric field E is produced by applying a voltage V across first and second electrode plates 30, 40. Each time a charged particle travels between first and second electrode plates 30, 40 of accelerating elements 20A and 20B, the charged particle is influenced by the associated electric field E, thereby increasing the velocity of charged particle.

In the illustrated embodiment, the charged particle is an electron. The electron is repulsed by the negatively charged first electrode plate 30, and is attracted to the positively charged second electrode plate 40. Consequently, the charged particle travels in a clockwise direction, as shown by orbit OR1 in FIGS. 1 and 2.

The kinetic energy (KE) of charged particles can be expressed as follows:

$$KE=\tfrac{1}{2}mv^2=KE_i+(V)(1.602\times10^{-19}\,J/eV)$$

where m is the mass of the charged particle, v is the velocity of the charged particle, V is the voltage applied to accelerating elements 20A, 20B, and $KE_i$ is the initial kinetic energy of the charged particle when exiting the particle injector. The final kinetic energy ($KE_f$) of the charged particles passing through a plurality of accelerating elements can be expressed as follows:

$$KE_f=KE_i+N(V)(1.602\times10^{-19}\,J/eV)$$

where $KE_i$ is the initial kinetic energy of the charge particle when exiting the particle injector, and "N" is the number of times the charged particle travels through an accelerating element as it follows a generally circular orbit. The final kinetic energy ($Ke_f$) of the charged particles passing through N accelerating elements can be expressed as follows:

$$KE_f=KE_i+(N)(V)1.602\times10^{-19}\,J/eV)$$

The magnitude and polarity of voltage V applied to accelerating elements 20A, 20B may be varied in order to modify the electric field E influencing the charged particles. In this regard, the magnitude of voltage V may be increased or decreased to respectively increase or decrease the acceleration of the charged particles. Furthermore, the polarity of voltage V may be reversed to decelerate the charged particles.

As indicated above, the transverse magnetic field B influences orbit OR1 of the charged particles. In this regard, magnetic filed B alters the radius R of the generally circular orbit of the charged particles as they pass through accelerating elements 20A, 20B, according to the following equations:

$$\vec{F}=q\vec{v}\times\vec{B}\ \text{(Lorentz force)}$$

$$\vec{F}=\frac{mv^2}{R}$$

$$\frac{mv^2}{R}=qvB$$

$$R=\frac{mv^2}{qvB}=\frac{mv}{qB},$$

$$KE=\frac{1}{2}mv^2\ \text{(Joules)}$$

$$v=\sqrt{\frac{2}{m}(KE)}$$

$$R=\frac{m[(2/m)(KE)]^{1/2}}{qB}=\frac{[2m(KE)]^{1/2}}{qB}$$

$$R=\frac{m*(KE_i+V)}{q*B}\ \text{(original equation)}$$

where m is the mass of the charged particle (e.g., $m_{electron}=9.11\times10^{-31}$ kg), q is the electrical charge of the charged particle (e.g., $q_{electron}=1.6\times10^{-19}$ C), and V is the voltage applied to the accelerating elements.

The present invention will now be further described by way of the following examples of charged particle acceleration.

EXAMPLE 1

Parameters:

Particle Type: Electron $KE_i$=50 keV

Accelerating Voltage V=50 kV

Number of Accelerating Elements N=4

The radius of the first and last orbits of accelerating electrons, at kinetic energies (KE) ranging from 1 MeV to 100 MeV, is provided in Table 1 below:

| Kinetic Energy (KE) MeV | Magnetic Field B Tesla | Radius R of First Orbit, cm | Radius R of Last Orbit, cm |
|---|---|---|---|
| 1.0 | 0.05 | 2.2 | 7.0 |
| 5.0 | 0.05 | 2.2 | 16.0 |
| 10.0 | 0.05 | 2.2 | 22.1 |
| 30.0 | 0.05 | 2.2 | 38.3 |
| 50.0 | 0.05 | 2.2 | 49.5 |
| 100.0 | 0.05 | 2.2 | 70.0 |

A beam current of 0.1 mA is needed to produce an electron beam with a kinetic energy of 50 MeV and power of 5 kW. The diameter of the electron beam is about 0.5 cm for a current density of 0.5 mA/cm$^2$.

EXAMPLE 2

Parameters:

Particle Type: Proton $KE_i$=50 keV

Accelerating Voltage V=50 kV

Number of Accelerating Elements N=4

| Kinetic Energy (KE) of Protons, MeV | Magnetic Field B, Tesla | Radius R of First Orbit, cm | Radius R of Last Orbit, cm |
|---|---|---|---|
| 1.0 | 20.0 | 6.7 | 30.0 |
| 10.0 | 20.0 | 6.7 | 94.0 |
| 50.0 | 20.0 | 6.7 | 200.0 |
| 100.0 | 20.0 | 6.7 | 300.0 |

EXAMPLE 3

Parameters:

Particle Type: Ion ($C^{+3}$)

$KE_i$=50 keV

Accelerating Voltage V=50 kV

Number of Accelerating Elements N=4

| Kinetic Energy (KE) of Carbon Ion $C^{+3}$, MeV | Magnetic Field B, Tesla | Radius R of First Orbit, cm | Radius R of Last Orbit, cm |
|---|---|---|---|
| 1.0 | 30.0 | 18.1 | 81.0 |
| 10.0 | 30.0 | 18.1 | 253.0 |
| 50.0 | 30.0 | 18.1 | 540.0 |

EXAMPLE 4

Parameters
Particle Type: Ion ($Ta^{+40}$)
$KE_1$=50 keV
Accelerating Voltage V=50 kV
Number of Accelerating Elements N=4

| Kinetic Energy (KE) of Tantalum Ion $Ta^{+40}$, MeV | Magnetic Field B, Tesla | Radius R of First Orbit, cm | Radius R of Last Orbit, cm |
|---|---|---|---|
| 1.0 | 100.0 | 6.2 | 27.0 |
| 10.0 | 100.0 | 6.2 | 85.4 |
| 50.0 | 100.0 | 6.2 | 190.0 |

Figure 4:
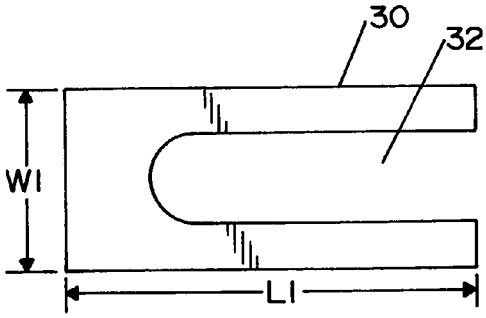
FIG. 4 is a front plan view of an electrode plate.
Figure 5:
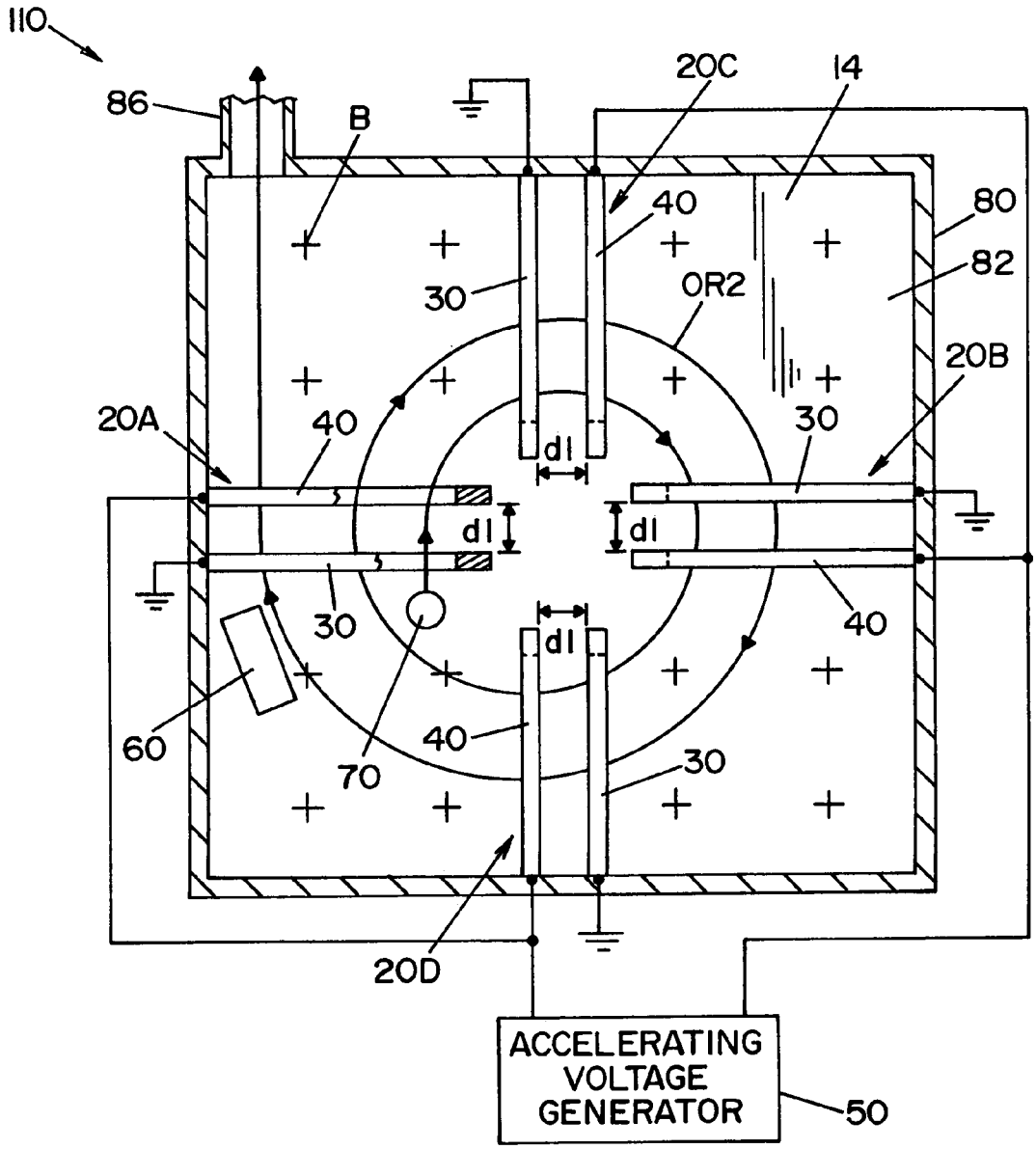
FIG. 5 is a partially sectioned top plan view similar to FIG. 2, showing a second embodiment of the present invention.

FIG. 4 illustrates a particle accelerator 110, according to a second embodiment of the present invention. Particle accelerator 110 includes four accelerating elements 20A, 20B, 20C and 20D arranged at 90 degrees to each other. The charged particles travel a generally circular orbit OR2. By increasing the number of accelerating elements to four, the charged particles can be more quickly accelerated to a higher velocity. As discussed above, the velocity of a charged particle will increase each time the charged particle travels between first and second electrode plates 30, 40. The electric field E associated with each accelerating element 20A, 20B, 20C and 20D will influence the charged particles, thereby increasing the velocity thereof.

It should be appreciated that the arrangement and quantity of accelerating elements illustrated in the preferred embodiment is exemplary only. In this regard, the number of accelerating elements may vary depending upon the desired particle velocity, the size of chamber 82, the type of particle being accelerated, and the particular application. Furthermore, an odd number of accelerating elements may be used, rather than the illustrated even number of accelerating elements.

Other modifications and alterations will occur to others upon their reading and understanding of the specification. It is intended that all such modifications and alterations be included insofar as they come within the scope of the invention as claimed or the equivalents thereof.

Having described the invention, the following is claimed:

1. A particle accelerating apparatus for accelerating charged particles, comprising:

at least two pair of accelerating elements, each accelerating element including a first electrode plate and a second electrode plate, wherein said first and second electrode plates are spaced apart by a gap;

first and second magnets for producing a magnetic field B transverse to a travel path of the charged particles through said gaps of said at least two pair of accelerating elements, to confine the charged particles to a generally circular orbit, wherein said plurality of accelerating elements are located between said first and second magnets; and a voltage generator for applying a voltage V across each of said first and second electrode plates.

2. A particle accelerating apparatus according to claim 1, wherein said apparatus further comprises particle injection means for providing a source of said charged particles.

3. A particle accelerating apparatus according to claim 1, wherein said apparatus further comprises:

a housing defining a chamber wherein said plurality of accelerating elements are located, said housing including an output port for said charged particles to exit said housing.

4. A particle accelerating apparatus according to claim 1, wherein said apparatus further comprises a deflecting magnet for modifying a trajectory of said charged particles.

5. A particle accelerating apparatus according to claim 1, wherein said apparatus further comprises means for reducing the pressure inside said chamber.

6. A particle accelerating apparatus according to claim 1, wherein each of said first and second electrode plate includes a slot formed therein.

7. A particle accelerating apparatus according to claim 1, wherein said voltage V is in the range of 10 kV to 100 kV.

8. A particle accelerating apparatus according to claim 1, wherein said magnetic field B is in the range of 0.05 T to 50 T.

9. A circular accelerator for accelerating the velocity of a charged particle, comprising:

at least two accelerating gaps;

means for producing an electric field in said accelerating gaps, wherein said charged particle is accelerated by said electric field; and means for producing a magnetic field transverse to a travel path of the charged particle through said at least two accelerating gaps, wherein the travel path of said charged particle is confined by said magnetic field to a generally circular orbit.

10. A circular accelerator according to claim 9, wherein each said accelerating gap is located between a first electrode plate and a second electrode plate.

11. A circular accelerator according to claim 10, wherein said first and second electrode plates include a slot formed therein.

12. A circular accelerator according to claim 9, wherein said means for producing the electric field includes a voltage generator.

13. A circular accelerator according to claim 9, wherein said means for producing the magnetic field includes a first and a second magnet.

14. A method for accelerating a charged particle, comprising:

applying a voltage across at least two pair of electrode plates, each pair of electrode plates defining an accelerating gap, wherein said voltage produces an associated electric field;

applying a magnetic field transverse to a travel path of the charged particle through said accelerating gaps of said at least two pair electrode plates; and injecting the charged particle into said accelerating gap of one of said two pair of electrode plates; wherein said magnetic field confines the charged particle a generally circular orbit.

15. A method for accelerating a charged particle according to claim 14, wherein said method further comprises:

deflecting said charged particle by a magnetic field, wherein said charged particle is diverted from said generally circular orbit.

* * * * *